US006226904B1

(12) United States Patent
Brady et al.

(10) Patent No.: US 6,226,904 B1
(45) Date of Patent: May 8, 2001

(54) BURN GUARD ELECTRIC IRON SOLEPLATE

(75) Inventors: Martin Brady, Chesterfield; Ramon R. Rodriquez, Richmond, both of VA (US)

(73) Assignee: Hamilton Beach/Proctor-Silex, Inc., Glen Allen, VA (US)

( * ) Notice: Subject to any disclaimer, the term of this patent is extended or adjusted under 35 U.S.C. 154(b) by 0 days.

(21) Appl. No.: 09/388,250

(22) Filed: Sep. 1, 1999

(51) Int. Cl.[7] ..... D06F 75/40
(52) U.S. Cl. ..... 38/96; 38/95
(58) Field of Search ..... 38/79, 96, 80, 38/81, 97, 94; D32/71

(56) References Cited

U.S. PATENT DOCUMENTS

| | | | | |
|---|---|---|---|---|
| D. 24,240 | | 4/1895 | Graves . | |
| D. 82,226 | | 10/1930 | Samuels . | |
| D. 98,166 | | 1/1936 | Jepson . | |
| D. 122,285 | | 9/1940 | Davis . | |
| D. 130,826 | | 12/1941 | Norbeck . | |
| D. 153,350 | | 4/1949 | Gelb . | |
| D. 153,993 | | 5/1949 | Stanley . | |
| D. 155,534 | | 10/1949 | Noordhof . | |
| D. 176,973 | | 2/1956 | Braddock . | |
| D. 191,007 | | 8/1961 | Caddell . | |
| 194,371 | | 8/1877 | Raymond . | |
| D. 246,497 | | 11/1977 | Toyosawa . | |
| D. 336,700 | | 6/1993 | Reimann . | |
| D. 366,545 | | 1/1996 | Sambamurti . | |
| D. 396,915 | | 8/1998 | McIntyre . | |
| 962,894 | | 6/1910 | Emery . | |
| 1,847,808 | * | 3/1932 | Beavan | 38/96 |
| 1,972,218 | | 9/1934 | Duvall . | |
| 2,095,954 | | 10/1937 | Beck . | |
| 2,447,555 | | 8/1948 | Beaudoin . | |
| 2,462,319 | | 2/1949 | Hawkins . | |
| 2,485,472 | | 10/1949 | Baxter . | |
| 2,528,846 | | 11/1950 | Sitnick et al. . | |
| 2,529,132 | | 11/1950 | Burnish, III et al. . | |
| 2,575,118 | | 11/1951 | Pattison . | |
| 2,598,347 | | 5/1952 | Butera . | |
| 2,750,696 | * | 6/1956 | Krammes | 38/96 |
| 2,838,647 | | 6/1958 | Gorlinski . | |
| 3,523,176 | | 8/1970 | Hill . | |
| 5,074,066 | * | 12/1991 | Sakano et al. | 38/79 X |
| 5,404,662 | | 4/1995 | Patrick et al. . | |
| 5,414,945 | | 5/1995 | Freeman et al. . | |
| 5,512,728 | | 4/1996 | Jalbert . | |
| 5,526,596 | | 6/1996 | Bitzel et al. . | |
| 5,937,552 | | 8/1999 | Hall . | |
| 5,966,851 | * | 10/1999 | Serpa | 38/79 |

FOREIGN PATENT DOCUMENTS 0 322 638A1 7/1989 (EP) .

OTHER PUBLICATIONS

U. S. Patent Des. 421,325 issued Feb. 29, 2000.

* cited by examiner

*Primary Examiner*—Ismael Izaguire
(74) *Attorney, Agent, or Firm*—Roger S. Dybvig

(57) ABSTRACT

An iron guard for holding, cooling, and storing an electric iron after use thereof. The iron guard includes a base member and upwardly extending side members. A plurality of flanges extend inwardly from the side members and are capable of slidable engagement with the electric iron to support the soleplate in spaced relation to the base member, thereby providing a gap between the soleplate and the base member to minimize heat transfer from the soleplate to the iron guard.

15 Claims, 2 Drawing Sheets

BURN GUARD ELECTRIC IRON SOLEPLATE

BURN GUARD FOR ELECTRIC IRON SOLEPLATE

1. Field of the Invention

The present invention relates generally to electric irons, and more particularly to guards for electric iron soleplates.

2. Background of the Invention

Iron guards are commonly used for covering hot iron soleplates during cooling to promote safe handling and storage. Iron guards not only protect other objects from damage caused by the cooling soleplate, they also protect the soleplate from damage caused by other objects, such as scratching, chipping, or denting. Iron guards also protect users or others from coming into contact with the cooling soleplate.

Typically, iron guards are wall mounted or horizontally oriented members which receive an iron having a hot soleplate. Many of these iron guards can withstand such high temperatures and promote cooling of the soleplate by using ribs or buttons to support the soleplate above the iron guard surface thereby creating an air insulating barrier between the cooling soleplate and the iron guard. See U.S. Pat. No. 2,529,132 issued to Burnish, III and U.S. Pat. No. 5,414,945 issued to Freeman et al. However, these ribs or buttons directly contact the bottom surface of the soleplate during storage, insertion, and removal of the iron from the iron guard. This type of abrasive contact, especially when the soleplate is hot, can easily scratch or damage the surface of the soleplate.

Recently, heat resistant plastics have been used to make iron guards. Heat resistant plastics have the benefit of being easy to use, inexpensive to manufacture, and are less likely to damage the soleplate. Plastics are also insulators and do not transfer heat as easily as other materials. But even with the use of heat resistant plastics, most contemporary iron guards are still capable of scratching or damaging the soleplate due to direct contact between the iron guard and the soleplate. Also, many soleplates in use today now include a TEFLON coating on the soleplate to protect clothes from scorching and to protect the soleplate from dirt and damage. The TEFLON coating can be easily scratched or worn by repeated direct contact between the soleplate and the iron guard.

OBJECTS AND SUMMARY OF THE INVENTION

An object of the present invention is to provide a storage base or guard for an iron that can store the iron after use in such a position that the surface of the soleplate does not rest on any portion of the iron guard thereby preventing a possible hazardous condition or possible damage to the soleplate or iron guard.

Another object of the present invention is to provide an iron guard that promotes quick and efficient cooling of the iron soleplate during storage.

It is a further object of this invention to provide a durable iron guard which can be easily and cost effectively manufactured.

Yet another object of the present invention is to reduce the amount of overall contact between the surface of the soleplate and the iron guard to reduce the risk of scratching or damaging the soleplate.

Yet another object of this invention is to prevent the scratching and wearing of the soleplate and its TEFLON coated surface by minimizing the contact between soleplate and the iron guard during insertion and removal.

In accordance with the foregoing objects, the present invention comprises an iron guard made from heat resistant plastic. The iron guard includes a base member and upwardly extending side members. A plurality of flanges extend inwardly from the side members and are capable of slidable engagement with the electric iron. Upwardly sloping ramp members on the iron guard guide the iron into a position in which the flanges enter the groove formed between the bottom surface of the base cover and the top surface of the soleplate. When the iron is supported by the iron guard, the flanges of the iron guard engage the bottom surface of the base cover to support the iron. As a result of supporting the iron, the soleplate is supported in spaced relation to the base member, thereby defining a gap between the soleplate and the base member, to minimize heat transfer from the soleplate to the iron guard.

The foregoing and other objects and advantages of this invention will become apparent from the following description and the accompanying drawings.

DETAILED DESCRIPTION

Figure 1:
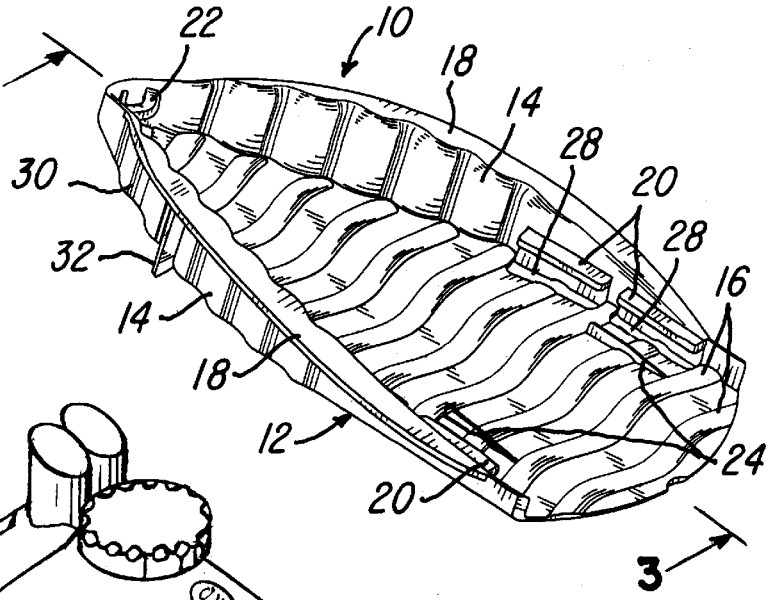
FIG. 1 is a perspective view of the iron guard of the present invention.

Referring to FIG. 1, there is shown in perspective an iron guard 10 of the present invention. In the preferred embodiment, iron guard 10 is molded from a heat resistant plastic which is inexpensive to manufacture and easy to handle. Although many types of heat resistant plastics are available, it is presently preferred to use VALOX-CS 860 manufactured by the General Electric Company. It is also presently preferred that the iron guard 10 be of one-piece molded plastic construction having a wall thickness of generally 0.100 of an inch.

Figure 6:
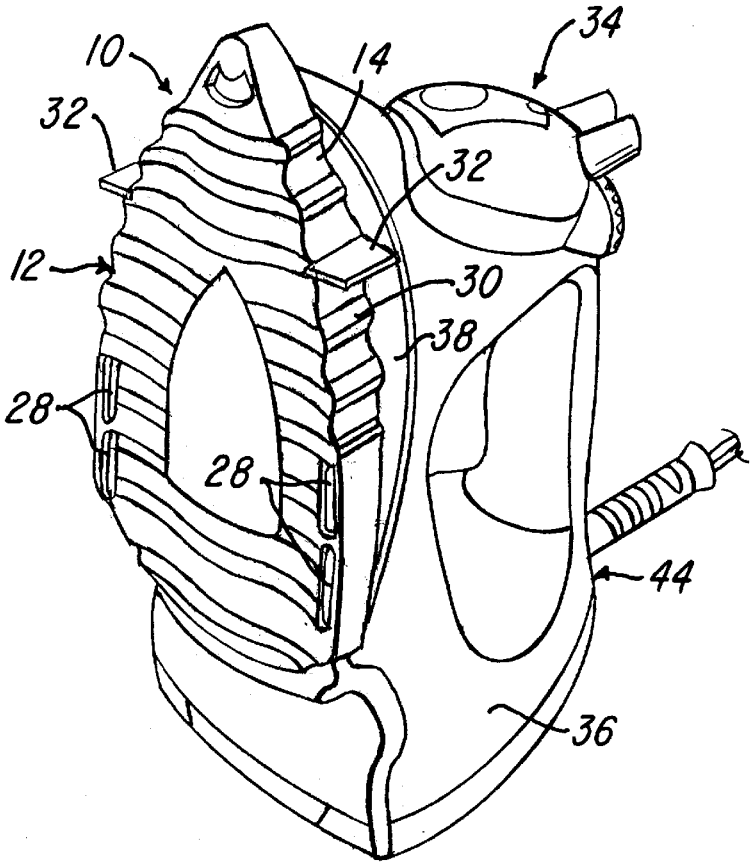
FIG. 6 is a perspective view similar to FIG. 2 but showing the iron standing in an upright position and finally engaged with the iron guard.

The iron guard 10, illustrated in FIG. 1, includes a base member 12 and side members 14. Base member 12 includes ribs 16 used primarily for stiffening purposes and adding durability to base member 12. Side members 14 extend upwardly from base member 12 with finger guard members 18 extending outwardly from side members 14. Mutually confronting rear flanges 20 extend inwardly from side members 14 near the rearward end of base member 12, while a front flange 22 extends inwardly from side members 14 at the forward end of base member 12. Rear ramp members 24 extend upwardly from the rearward end of base member 12, while front ramp members 26 extend upwardly from the forward end of base member 12. A number of apertures 28, best illustrated in FIG. 6, are also formed in base member 12 as a result of the molding process and will be discussed below.

Side members 14 are spaced apart from one another at the rearward end of base member 12 and converge at the forward end of base member 12 creating an iron guard 10 corresponding substantially to the shape of an iron soleplate. Side members 14 include a scalloped or undulating exterior surface 30 to allow the user to more easily grasp the sides of the iron guard 10 when inserting or removing the iron from the iron guard 10. Stop guards 32 extend outwardly from the undulating exterior surface 30 of side members 14. The stop guards 32 are used to keep the user's fingers from sliding over the undulating surfaces 30 thereby preventing the user's hand from sliding up or down the iron guard 10 and possibly into contact with the hot soleplate. Likewise, outwardly extending finger guard members 18 prevent users from extending their fingers completely over side members 14 and possibly into contact with the hot soleplate or any steam which may be escaping from the iron.

Figure 2:
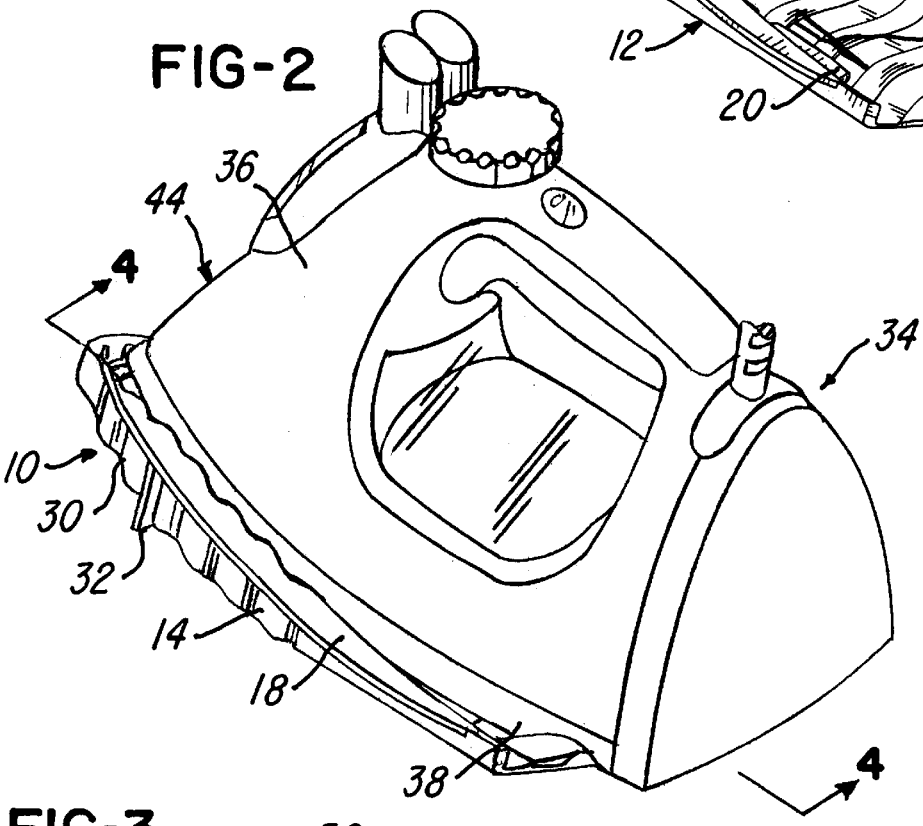
FIG. 2 is a perspective view similar to FIG. 1 but showing the iron guard supporting and in final engagement with the iron.
Figure 3:
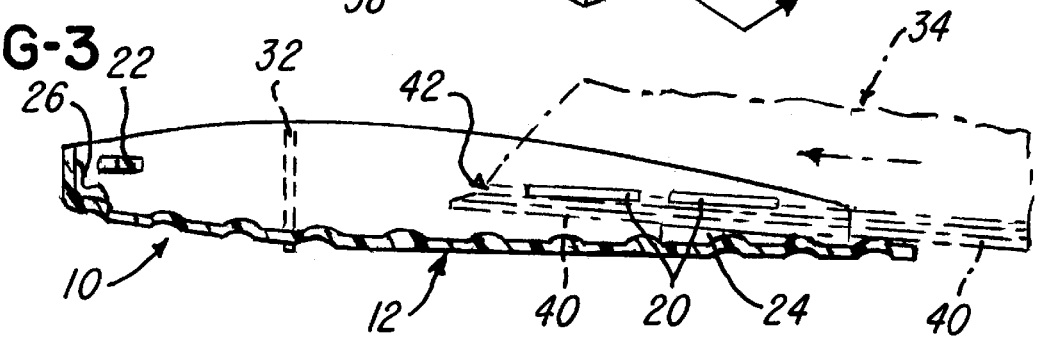
FIG. 3 is a cross-sectional view taken along line 3—3 of FIG. 1 showing the iron in phantom during the initial stage of engagement with the iron guard.
Figure 4:
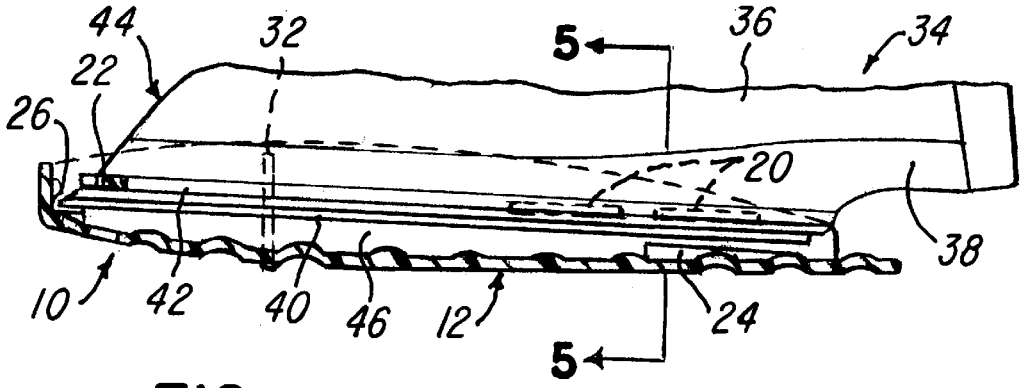
FIG. 4 is cross-sectional view taken along line 4—4 of FIG. 2 showing the iron guard supporting and in final engagement with the iron.

As illustrated in FIGS. 2 and 4, irons 34 generally comprise an iron handle 36 attached to a base cover 38 which, in turn, is attached to the soleplate 40. Groove 42, as best illustrated in FIGS. 3 and 4, is formed between the top surface of the soleplate 40 and the bottom surface of the base cover 38. Groove 42 enables the user to readily iron garments having buttons and also functions to receive rear and front flanges 20,22 as described below. For purposes of this discussion, the iron handle 36 and the base cover 38 could be generally referred to as the iron housing 44. Although it is preferred that the rear and front flanges 20,22 slidably enter groove 42 and engage the bottom surface of the base cover 38, it is obvious that they could also engage the iron 34 anywhere along the iron housing 44 having a groove or opening similar to groove 42.

Referring now to FIG. 3 and the operation of iron guard 10, iron 34 is initially slid toward to forward end of the base member 12, as indicated by the arrow, along rear ramp members 24. Rear ramp members 24 properly guide iron 34 onto iron guard 10. In order to minimize the abrasive contact between the soleplate 40 and the rear ramp members 24, and to easily guide the soleplate 40 into position, the rear ramp members 24 gradually slope upwardly from the rearward end of base member 12 to forward end of base member 12. As the surface of soleplate 40 momentarily makes contact with the rear ramp members 24, and the iron 34 is slid toward the forward end of base member 12, the rear ramp members 24 align rear flanges 20 with groove 42.

As the iron 34 continues to be slid toward the forward end of base member 12, rear flanges 20 sliding within groove 42 begin to engage the bottom surface of base cover 38 thereby supporting iron 34 above base member 12. As the iron 34 is further inserted into iron guard 10, the sloped front ramp members 26 properly guide the nose of soleplate 40 thereby aligning groove 42 with front flange 22. To reduce the surface area momentarily in contact with the surface of soleplate 40, the surfaces of rear and front ramp members 24,26 are preferably rounded. It is noted that the rear and front ramp members 24,26 are positioned to contact the soleplate 40, and the rear and front flanges 20,22 are positioned to support the iron 34, remote from the hottest portion of soleplate 40.

Figure 5:
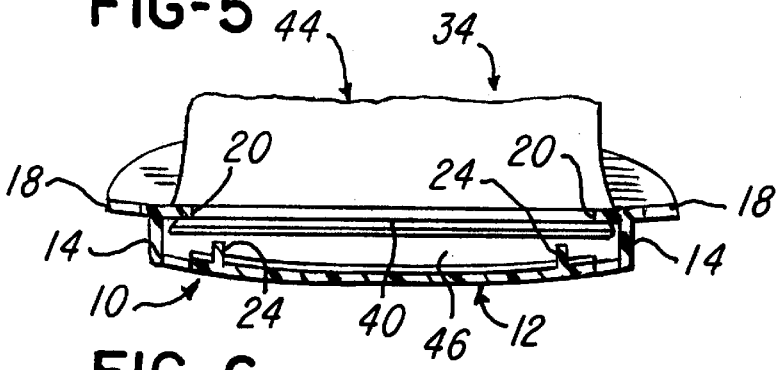
FIG. 5 is a rear elevational view taken along line 5—5 of FIG. 4 showing the spaced relation or gap created between the soleplate and the iron guard during finally engagement.

When iron 34 is slid into final engagement with the iron guard 10, as shown in FIGS. 4 and 5, the rear and front flanges 20,22, which have slidably entered groove 42, engage the bottom surface of base cover 38 to completely support the iron 34 with the soleplate 40 supported in spaced relation to the base member 12 thereby defining a gap 46 between the soleplate 40 and the base member 12. When the iron 34 is completely supported by the iron guard 10, the preferred embodiment provides for the gap 46 between the soleplate 40 and the surface of the rear ramp members 24 to be 0.030 inches. Therefore, the entire bottom surface of the soleplate 40 is free from contact with the iron guard 10.

As best illustrated in FIG. 4, the base member 12 in the preferred embodiment is curved downwardly to maximize the gap 46 between the base member 12 and the soleplate 40. The base member 12 is curved to separate the iron guard 10 from the hottest areas of the soleplate, thereby minimizing heat transfer from the soleplate 40 to the iron guard 10. The air within gap 46 insulates base member 12 from the initially high temperature of cooling soleplate 40 and enables the surface of soleplate 40 to properly cool while not in contact with iron guard 10. Apertures 28, formed in base member 12, also increase the cooling of soleplate 40 by allowing ambient air to enter gap 46. Ambient air entering gap 46 from apertures 28 or the rearward end of base member 12 absorbs heat from the cooling soleplate 40. The heated air then escapes to the atmosphere between the soleplate 40 and side members 14 thereby assisting in cooling soleplate 40.

It is noted that the construction of this invention enables an iron 34 to slidably engage and be supported by an iron guard 10 as explained above. However, as would be readily apparent to one skilled in the art, and as illustrated in FIG. 6, the iron guard 10 of this invention can conversely slidably engage and be supported by iron 34, whereby the rear and front flanges 20,22 support the base member 12 in spaced relation to the soleplate 40.

Due to the use of heat resistant plastic and the construction of the iron guard 10 for supporting a cooling iron 34, the iron guard 10 does not reach its peak temperature, between 165 and 170 degrees F., for 5.5 minutes. This temperature is well below that which requires a hazardous warning during normal use. If the iron 34 is left on, an abnormal condition, the iron guard 10 reaches its maximum temperature, 220 degrees F., in ten minutes due to the iron 34 cycling on and off. Even with the iron soleplate 40 cycling between 380 and 400 degrees F., the heat resistant plastic and the construction of the iron guard 10 prevents the iron guard 10 from reaching temperatures above 220 degrees F. And because plastics do not transfer heat to someone touching the part as would metal, the plastic piece would feel much cooler to the touch than the metal piece.

Although an object of the present invention is to prevent contact between the bottom surface of the soleplate and the iron guard during final engagement, it is recognized that manufacturing tolerances, repeated use, and other factors are such that incidental contact between the bottom surface of the soleplate and the iron guard could occur in some instances.

Although the presently preferred embodiments of this invention have been described, it will be understood that within purview of this invention various changes may be made within the scope of the following claims.

Having thus described our invention, we claim:

1. An iron guard for use with an electric iron, said electric iron including an iron soleplate, said iron guard comprising:

a body made from a heat resistant material including a base member having a forward end and a rearward end;

mutually opposed side members extending upwardly from said base member which one may grasp when mounting an iron having a hot soleplate on said guard or when removing an iron from said guard;

at least one pair of mutually confronting flanges extending inwardly from said side members, said flanges capable of engaging said iron to support said soleplate in spaced relation to said base member; and finger guard members extending outwardly from side members to prevent one from extending their fingers completely over said side members and possibly into contact with said soleplate when hot.

2. The iron guard of claim 1 wherein said side members have mutually opposed undulating surfaces to assist one in more easily grasping said iron guard.

3. The iron guard of claim 1 wherein said base member is curved downwardly to maximize the spacing between said soleplate and said base member.

4. The iron guard of claim 3 further comprising a plurality of apertures formed in said base member through which ambient air can enter between said soleplate and said base member to increase the cooling of said soleplate.

5. The iron guard of claim 4 wherein said iron guard is made from a heat resistant plastic.

6. An iron guard for use with an electric iron, said electric iron having a groove formed between the top surface of the soleplate and the bottom surface of the base cover, said iron guard comprising:

a base member having a forward end and a rearward end;

mutually opposed side members extending upwardly from said base member; and at least one pair of mutually confronting flanges extending inwardly from said side members, said flanges capable of entering said groove to support said iron and thereby said soleplate in spaced relation to said base member.

7. The iron guard of claim 6 wherein said base member is curved downwardly to maximize the spacing between said soleplate and said base member.

8. The iron guard of claim 6 further comprising at least one ramp member extending upwardly from said base member, said ramp member capable of guiding said iron to align said groove with said flanges.

9. The iron guard of claim 8 wherein said side members are spaced apart from one another at said rearward end and converged at said forward end.

10. The iron guard of claim 9 further comprising a front flange extending inwardly from said side members at said forward end and capable of entering said groove to support said iron in spaced relation to said base member.

11. The iron guard of claim 10 further comprising at least one front ramp member extending upwardly from said base member, said front ramp member capable of guiding said iron to align said groove with said front flange.

12. The iron guard of claim 11 wherein said iron guard is made from a heat resistant plastic.

13. An iron guard for use with an electric iron, said electric iron having a groove formed between the top surface of the soleplate and the bottom surface of the base cover, said iron guard comprising:

a base member having a forward end and a rearward end;

mutually opposed side members extending upwardly from said base member, said side members spaced apart from one another at said rearward end and converged at said forward end;

at least one pair of mutually confronting rear flanges extending inwardly from said side members capable of engaging said groove;

at least one front flange extending inwardly from said side members at said forward end capable of entering said groove whereby said soleplate is supported in spaced relation to said base member when said front and rear flanges enter into said groove.

14. The iron guard of claim 13 further comprising at least one ramp member extending upwardly from said base member, said ramp member capable of guiding said iron to align said groove with said flanges.

15. The iron guard of claim 14 wherein said base member is curved downwardly to maximize the spacing between said soleplate and said base member.

* * * * *